US008824912B2

(12) United States Patent
Zeng et al.

(10) Patent No.: US 8,824,912 B2
(45) Date of Patent: Sep. 2, 2014

(54) IMAGE FORMING APPARATUS AND METHOD

(71) Applicant: Zhuhai Seine Technology Co., Ltd., Zhuhai (CN)

(72) Inventors: Yangyun Zeng, Zhuhai (CN); Wanli Sun, Zhuhai (CN)

(73) Assignee: Zhuhai Seine Technology Co., Ltd., Zhuhai (CN)

( * ) Notice: Subject to any disclaimer, the term of this patent is extended or adjusted under 35 U.S.C. 154(b) by 0 days.

(21) Appl. No.: 13/948,125

(22) Filed: Jul. 22, 2013

(65) Prior Publication Data

US 2013/0302057 A1 Nov. 14, 2013

Related U.S. Application Data

(63) Continuation of application No. PCT/CN2011/084206, filed on Dec. 19, 2011.

(30) Foreign Application Priority Data

Jan. 24, 2011 (CN) ..... 2011 1 0025783

(51) Int. Cl.
*G03G 15/20* (2006.01)

(52) U.S. Cl.
CPC ..... *G03G 15/2039* (2013.01)
USPC ..... 399/69; 399/67

(58) Field of Classification Search
None
See application file for complete search history.

(56) References Cited

U.S. PATENT DOCUMENTS

| | | | | | |
|---|---|---|---|---|---|
| 4,412,735 | A * | 11/1983 | Tsukata et al. | ..... | 399/81 |
| 5,550,621 | A * | 8/1996 | Ogawahara | ..... | 399/69 |
| 2006/0127112 | A1 * | 6/2006 | Ono | ..... | 399/38 |
| 2008/0019744 | A1 * | 1/2008 | Yamaguchi | ..... | 399/335 |

FOREIGN PATENT DOCUMENTS

| | | | | | |
|---|---|---|---|---|---|
| CN | 1746791 | A | | 3/2006 | |
| CN | 1786838 | A | | 6/2006 | |
| CN | 102117040 | A | | 7/2011 | |
| CN | 202041774 | U | | 11/2011 | |
| CN | 102117040 | B | | 7/2012 | |
| JP | 1007065 | A | | 1/1989 | |
| JP | 01-107286 | A | | 4/1989 | |
| JP | 04-140765 | A | | 5/1992 | |
| JP | H04-140765 | A | * | 5/1992 | ..... G03G 15/00 |
| JP | 2002-372879 | A | | 12/2002 | |

OTHER PUBLICATIONS

International Search Report of corresponding international Application No. PCT/CN2011/084206, dated Dec. 19, 2011.
Chinese First Examination Report of China Application No. 201110025783.5, dated Feb. 15, 2012.

* cited by examiner

*Primary Examiner* — Clayton E LaBalle
*Assistant Examiner* — Jas Sanghera
(74) *Attorney, Agent, or Firm* — J.C. Patents

(57) ABSTRACT

An image forming apparatus includes an image fixing device (9), a measuring module (101) and a control module (300). The measuring module (101) is used to measure the temperature of the image fixing device (9) to generate a temperature measure value. The control module (300) is used to control an execution mechanism to act to show that the image forming apparatus is in the working state, upon determining that the temperature measure value is lower than a preset threshold. The present invention further includes a corresponding image forming method. Advantages of the present invention are that, a user is clearly prompted that the apparatus is in a normal operation state, thereby bringing convenience to the use of the apparatus.

19 Claims, 4 Drawing Sheets

IMAGE FORMING APPARATUS AND METHOD

CROSS-REFERENCE TO RELATED APPLICATIONS

This application is a continuation of International Application No. PCT/CN2011/084206, filed on Dec. 19, 2011 which claims priority to Chinese Patent Application No. 201110025783.5, filed on Jan. 24, 2011, both of which are hereby incorporated by reference in their entireties.

FIELD OF THE INVENTION

The present invention relates to the image forming apparatus control technology, and specifically to an image forming apparatus and an image forming method.

BACKGROUND OF THE INVENTION

In an existing image forming apparatus, a heating roller in the apparatus needs to be preheated for a certain time before the image forming apparatus runs, and then the image forming apparatus may work normally.

Generally, when the image forming apparatus receives a signal of starting running, the preheating starts at the same time when the apparatus starts. Before the completion of the preheating, all other transmission components of the image forming apparatus are not in motion, and a user is prompted that the image forming apparatus is working, for example, by flashing an LED light.

However, since the preheating time is relatively long, usually longer than 10 seconds, the user probably may not notice the flashing of the LED light, or may not observe the flashing of the LED light in bright light, so that the user cannot determine whether the image forming apparatus is in normal operation. Moreover, the user may even think that a fault in the image forming apparatus has occurred while actually the apparatus runs normally, thus causing great inconvenience in use for the user.

SUMMARY OF THE INVENTION

The present invention provides an image forming apparatus and an image forming method, aiming to facilitate the user to determine the normal working state of the image forming apparatus.

An image forming apparatus according to the present invention includes an image fixing device, and further includes:

a measuring module, configured to measure a temperature of the image fixing device to generate a temperature measure value; and a control module, configured to control an execution mechanism to act to show that the image forming apparatus is in a working state, upon determining that the temperature measure value is lower than a preset threshold.

The control module includes:

a comparison module, configured to compare the temperature measure value with the preset threshold;

a driving module, configured to generate a driving signal to drive the execution mechanism to act to show that the image forming apparatus is in the working state, upon determining that the temperature measure value is lower than the preset threshold.

The driving module includes:

a main motor signal sub-unit, connected to a main motor of the image forming apparatus, and configured to generate a main motor driving signal to control the main motor to rotate for a set time, upon determining that the temperature measure value is lower than the preset threshold; and/or a laser scanning device signal sub-unit, connected to a laser scanning device of the image forming apparatus, and configured to generate a laser scanning device driving signal to control the laser scanning device to be turned on for a set time, upon determining that the temperature measure value is lower than the preset threshold; and/or a fan signal sub-unit, connected to a fan of the image forming apparatus, and configured to generate a fan driving signal to control the fan to work for a set time, upon determining that the temperature measure value is lower than the preset threshold; and/or a speaker signal sub-unit, connected to a speaker of the image forming apparatus, and configured to generate a speaker driving signal to control the speaker to be turned on for a set time, upon determining that the temperature measure value is lower than the preset threshold.

The preset threshold is in the range of 60° C.~100° C.

An image forming method according to the present invention, includes:

measuring a temperature of an image fixing device of an image forming apparatus to generate a temperature measure value;

comparing the temperature measure value with a preset threshold;

generating a driving signal to drive an execution mechanism to act to show that the image forming apparatus is in a working state, upon determining that the temperature measure value is lower than the preset threshold.

The generating the driving signal to drive the execution mechanism to act to show that the image forming apparatus is in the working state, includes:

generating a driving signal to drive a main motor of the image forming apparatus, and control the main motor to rotate for a set time; and/or generating a driving signal to drive a laser scanning device of the image forming apparatus, and control the laser scanning device to work for a set time; and/or generating a driving signal to drive a fan of the image forming apparatus, and control the fan to work for a set time; and/or generating a driving signal and sending the driving signal to a speaker, to control the speaker to work for a set time.

The preset threshold is in the range of 60° C.~100° C.

The method further includes, starting a timer at the same time when a driving signal is generated, and canceling the driving signal when the timer reaches the value of a set time.

The image forming apparatus and the image forming method according to the present invention measure, by the measuring module, the temperature of the image fixing device to generate the signal which shows that the image forming apparatus is in the working state, so as to prompt the user that the apparatus is running. Thus it facilitates the user to determine that the apparatus is running normally, overcomes the disadvantage of prompting the user only by flashing an LED light in the prior art, thereby facilitates the user to determine the working state of the image forming apparatus.

REFERENCE SIGNS

| | | |
|---|---|---|
| 2-processing box; | 3-photosensitive drum; | 4-charging unit; |
| 5-developing unit; | 6-powder feeding roller; | 7-doctor blade; |
| 8-transferring unit; | 9-image fixing device; | 11-stirring rack; |
| 13-paper supply roller; | 14-powder cabin; | 15-heating roller; |
| 16-pressure roller; | 31-main motor signal sub-unit; | 32-laser scanning device signal sub-unit; |
| 33-fan signal sub-unit; | 34-speaker signal sub-unit; | 35-timer; |
| 100-main motor; | 101-measuring module; | 102-comparison module; |
| 103-driving module; | 300-control module; | 400-fan; |
| 500-laser scanning device; | 600-speaker. | |

DETAILED DESCRIPTION OF THE EMBODIMENTS

In order to make the objects, technical solutions and advantages of embodiments of the present invention clearer, a clear and comprehensive description of the technical solutions in embodiments of the present invention is given with reference to the accompanying drawings. Obviously, the embodiments described herein are only a part rather than all of the embodiments of the present invention. All other embodiments derived by persons skilled in the art from the embodiments herein without any creative effort shall fall within the protection scope of the present invention.

Figure 1:
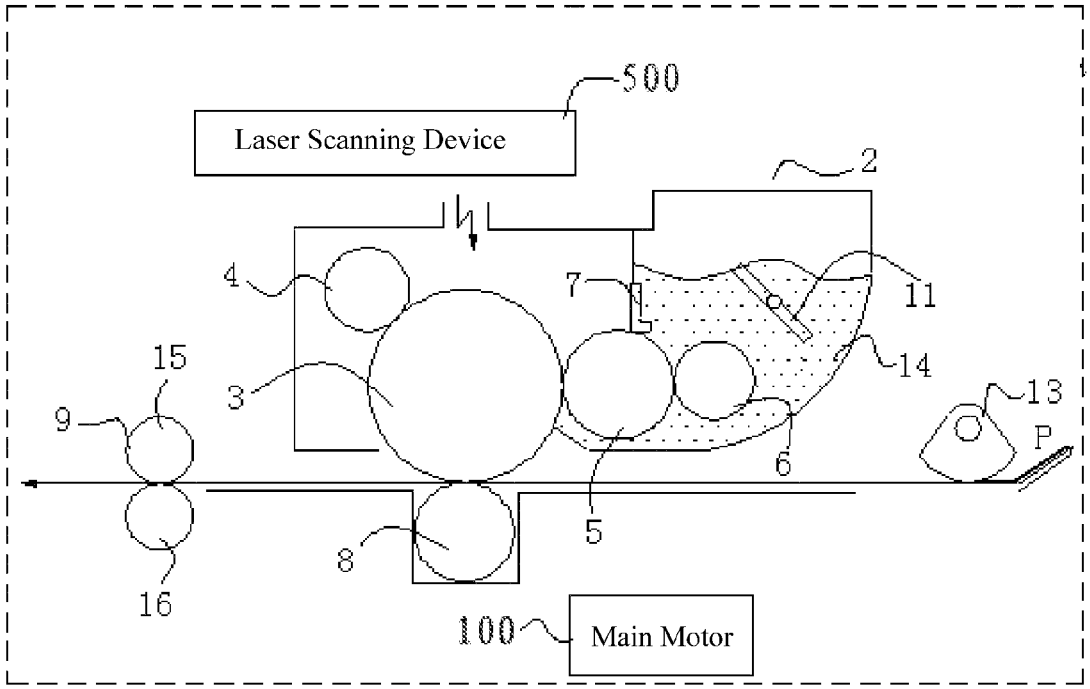
FIG. 1 is a schematic structural diagram of an image forming apparatus according to embodiment 1 of the present invention.
Figure 2:
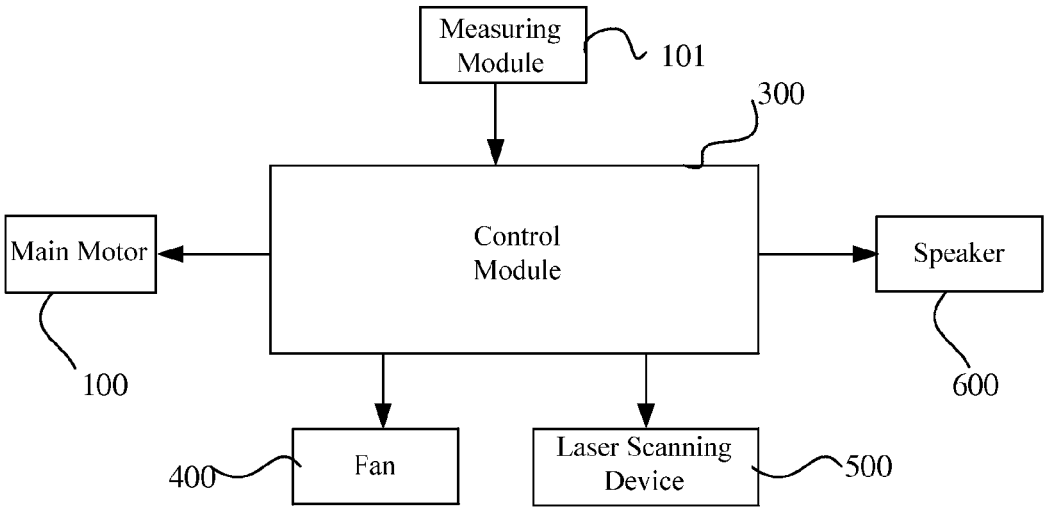
FIG. 2 is a schematic modular structural diagram of the image forming apparatus according to embodiment 1 of the present invention.
Figure 3:
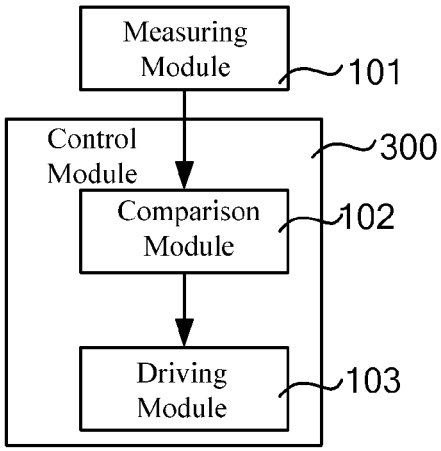
FIG. 3 is a partial schematic modular structural diagram of the image forming apparatus according to embodiment 1 of the present invention.

FIG. 1 is a schematic structural diagram of an image forming apparatus according to embodiment 1 of the present invention; FIG. 2 is a schematic modular structural diagram of the image forming apparatus according to embodiment 1 of the present invention; FIG. 3 is a partial schematic modular structural diagram of the image forming apparatus according to embodiment 1 of the present invention.

As shown in FIG. 1, FIG. 2 and FIG. 3, the image forming apparatus includes at least an image fixing device 9, a measuring module 101 and a control module 300. The measuring module 101 is configured to measure the temperature of the image fixing device 9 to generate a temperature measure value. The measuring module 101 is configured to measure the temperature of the image fixing device 9 which may include a heating roller 15, so that surface temperature of the heating roller 15 of the image fixing device 9 is usually measured. The measuring module 101 may be a measuring module of an existing image forming apparatus, and it is also possible to add a measuring component in the existing image forming apparatus to measure the surface temperature of the heating roller 15. The measuring module 101 may measure the surface temperature of the heating roller 15 in real time, which is usually achieved by a temperature sensor.

The control module 300 is configured to control an execution mechanism to act to show that the image forming apparatus is in the working state, upon determining that the temperature measure value is lower than a preset threshold.

The control module 300 may be implemented through software programs and associated interface circuits being built into the control device of an existing image forming apparatus, where the software programs and associated interface circuits have the function of driving module 300 of the present invention, and may also be implemented by adding a control module 300, where the control module 300 is typically implemented by an integrated circuit plate and a CPU containing a running software, of course, the control module 300 may also be achieved by other means, for example, through a PLC, not limited to this embodiment.

Solutions of measuring the temperature and controlling the execution mechanism by the image forming apparatus according to this embodiment may be applicable to any form of the image forming apparatus. FIG. 1 and FIG. 2 show an image forming apparatus with a typical structure. The image forming apparatus includes a processing box 2, a photosensitive drum 3, a charging unit 4, a developing unit 5, a powder feeding roller 6, a doctor blade 7, a transferring unit 8, an image fixing device 9, a stirring rack 11, a paper supply roller 13, a powder cabin 14, and further includes a main motor 100, a measuring module 101, a control module 300, a fan 400, a laser scanning device 500 and a speaker 600.

Where, the laser scanning device 500 is mounted opposite to the photosensitive drum 3; the charging unit 4, the developing unit 5 and the transferring unit 8 are located respectively around the photosensitive drum 3; the main motor 100 is connected respectively with the photosensitive drum 3, the charging unit 4, the developing unit 5 and the transferring unit 8.

The control module 300 is connected respectively with the main motor 100, the measuring module 101, the fan 400, the laser scanning device 500 and the speaker 600.

Where, the developing unit 5 may be a developing roller, and the image fixing device 9 typically includes a heating roller 15 and a pressure roller 16.

The photosensitive drum 3, the charging unit 4, the developing unit 5 and the like may be disposed in the processing box 2. The processing box 2 can also include the powder feeding roller 6, the powder cabin 14, the stirring rack 11 and the doctor blade 7, where the powder cabin 14 is used for storing carbon powder.

The paper supply roller 13 can supply recording medium, such as paper, and send the recording medium between the transferring unit 8 and the photosensitive drum 3, for transferring an image on the photosensitive drum 3 onto the recording medium. The image fixing device 9 includes the heating roller 15 and the pressure roller 16, for fixing the image on the recording medium. The measuring module 101 may be used to measure surface temperature of the heating roller 15 in the image fixing device 9.

The preset threshold used during the temperature comparison is also a temperature value. When the surface temperature of the heating roller is higher than the preset threshold, it indicates that the time from start of the preheating to completion of the preheating will be very short, thus determining whether the image forming apparatus is in the normal working state by the user will not be affected.

When the surface temperature of the heating roller is lower than the preset threshold, it indicates that the preheating time is relatively long, so that it is necessary to prompt the user via a display signal that the image forming apparatus is in the preheating state, rather than in failure.

In view of the above factors, the user can set as required. Preferably, in this embodiment, the preset threshold is in the range of 60° C. to 100° C., and the preset threshold is optimally 80° C.

The execution mechanism may utilize components of an existing image forming apparatus, for example, a main motor 100, a laser scanning device 500 of the existing image forming apparatus, and may also be a newly added component, such as a fan 400 or a speaker 600. Moreover, other execution mechanism may also be added, not limited to this embodiment.

Further, in this embodiment, as shown in FIG. 3, the control module 300 specifically includes a comparison module 102 and a driving module 103. The comparison module 102 is configured to compare the temperature measure value with the preset threshold. The driving module 103 is configured to generate a driving signal to drive the execution mechanism to act to show that the image forming apparatus is in the working state, upon determining that the temperature measure value is lower than the preset threshold.

Seen from the above technical solutions, when the image forming apparatus is being preheated, the measuring module measures the surface temperature of the heating roller in the image fixing device, and the control module generates a driving signal to drive the execution mechanism to act to show that the image forming apparatus is in the working state. Therefore, the user can easily determine that the image forming apparatus is in the preheating state, rather than in failure, thus bringing convenience to the use of the apparatus.

Embodiment 2

Figure 4:
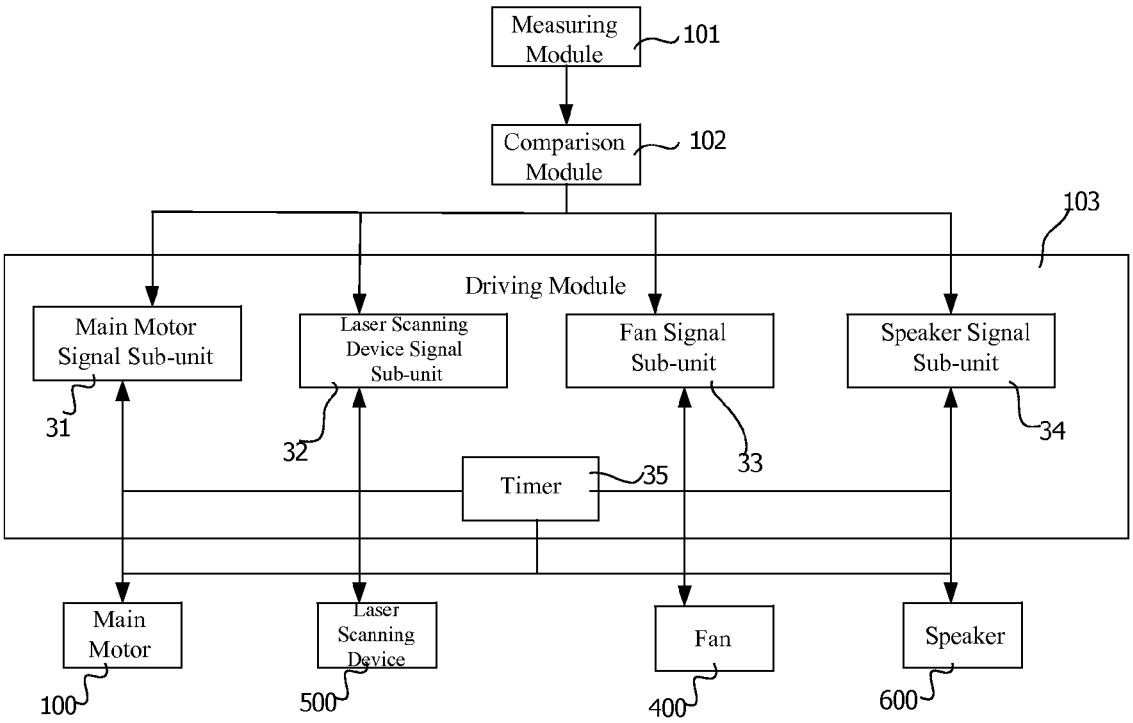
FIG. 4 is a partial schematic modular structural diagram of an image forming apparatus according to embodiment 2 of the present invention.

FIG. 4 is a partial schematic modular structural diagram of an image forming apparatus according to embodiment 2 of the present invention. The image forming apparatus includes a measuring module 101, a comparison module 102 and a driving module 103.

The driving module 103 specifically includes one or more of a main motor signal sub-unit 31, a laser scanning device signal sub-unit 32 or a fan signal sub-unit 33.

As shown in FIG. 2, FIG. 3 and FIG. 4, the main motor signal sub-unit 31 is connected with a main motor 100 of the image forming apparatus, and configured to generate a main motor driving signal, to control the main motor 100 to rotate for a set time, upon determining that the temperature measure value is lower than a preset threshold.

The laser scanning device signal sub-unit 32 is connected with a laser scanning device 500 of the image forming apparatus, and configured to generate a laser scanning device driving signal, to control the laser scanning device 500 to be turned on for a set time, upon determining that the temperature measure value is lower than the preset threshold.

The fan signal sub-unit 33 is connected with a fan 400 of the image forming apparatus, and configured to generate a fan driving signal, to control the fan 400 to work for a set time, upon determining that the temperature measure value is lower than the preset threshold.

Further, based on the above embodiment, the image forming apparatus also includes a speaker 600, and the driving module also includes a speaker signal sub-unit 34, which is connected with the speaker 600 and configured to generate a speaker driving signal, to control the speaker 600 to be turned on for a set time, upon determining that the temperature measure value is lower than the preset threshold.

The above-mentioned set time can be achieved through timing by a timer 35 disposed in the driving module 103. As shown in FIG. 4, the main motor signal sub-unit 31, the laser scanning device signal sub-unit 32, the fan signal sub-unit 33 and the speaker signal sub-unit 34 in the driving module 103 are connected respectively with the main motor 100, the laser scanning device 500, the fan 400 and the speaker 600 via the timer 35. The timer 35 starts at the same time when the driving signal is generated, and the driving signal is cancelled when the timer 35 reaches the value of the set time, thereby controlling the main motor 100 to rotate for the set time, the laser scanning device 500 to work for the set time, the fan 400 to rotate for the set time, or the speaker 600 to work for the set time.

It can also be achieved by a time relay. The controlled circuit is closed or disconnected through setting delay time or limit time of the time relay as the set time, thereby controlling the main motor to rotate for the set time, the laser scanning device to work for the set time, the fan to rotate for the set time or the speaker to work for the set time. Moreover, it can also be achieved by other means, not limited to this embodiment.

In the above embodiment, the main motor rotating for the set time, the laser scanning device working for the set time, the fan rotating for the set time or the speaker working for the set time, may be performed simultaneously, or one, two or three of them is/are performed simultaneously, which depends on the setting of the sub-unit in the driving module, not limited to this embodiment.

The set time in the above embodiment can be the same or different, which can be set by the user as required, and may be set to 3-5 seconds, not limited to this embodiment.

Furthermore, it should be noted that the role and the way of setting of the speaker may be different from those described in this embodiment, and it may not achieved by: measuring the surface temperature of the heating roller in the image fixing device, and then comparing the measure value with the preset threshold through the comparison module to generate a driving signal to control the speaker to work for the set time, as described in this embodiment. Instead, upon receiving a print command, the speaker signal sub-unit controls the speaker to work for the set time, so that the user can be prompted by the sound of the speaker that the image forming apparatus is in the preheating state, rather than in failure, so as to facilitate the user to determine the working state of the apparatus.

The image forming apparatus according to the embodiment of the present invention measures, by the measuring module, surface temperature of the heating roller, and compares the measured surface temperature of the heating roller with a preset threshold through the comparison module, to drive an execution mechanism to work. The user can be prompted by the sound of the execution mechanism working for the set time, that the image forming apparatus is in operation, rather than in failure, thus overcoming the disadvantage of prompting the user only by flashing an LED light in the prior art, thereby bringing convenience to the use of the apparatus.

Figure 5:
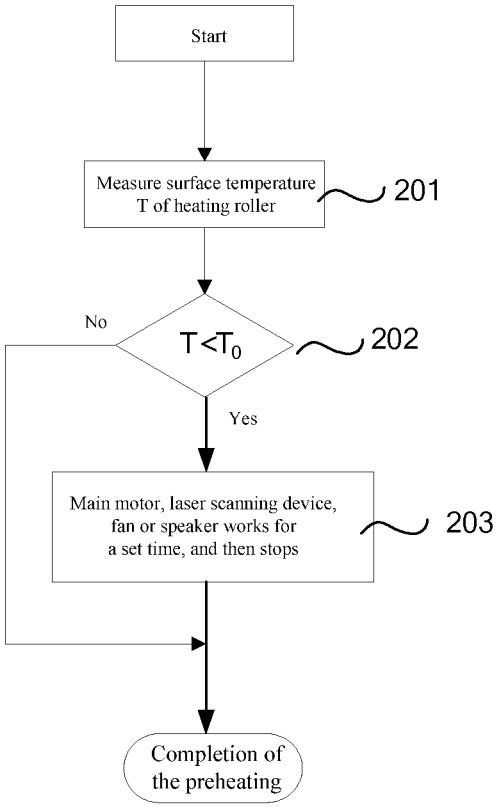
FIG. 5 is a flow chart of a preheating process of the image forming apparatus according to embodiment 2 of the present invention.

FIG. 5 is a flow chart of a preheating process of the image forming apparatus according to embodiment 2 of the present invention. The preheating process of the image forming apparatus is introduced with reference to FIG. 5.

The image forming apparatus will enter the preheating mode and start to be preheated when the power switch of the image forming apparatus is turned on, or the cover of the image forming apparatus is covered, or a print command is received, or the above-mentioned actions occur at the same time.

Step 201, a measuring module measures surface temperature of a heating roller in an image fixing device, and the surface temperature is set to T.

Step 202, the measuring module sends the measured temperature T to a comparison module, and the comparison module compares the measured temperature T with a preset threshold $T_0$, and then transmits the result of the comparison to a driving module.

Step 203, when the driving module determines that the measured temperature T is higher than the preset temperature $T_0$, the driving module will not send other commands, and a heating device of the image forming apparatus heats the heating roller continuously until the temperature reaches a desired value to complete the preheating operation.

When the driving module determines that the measured temperature T is lower than the preset temperature $T_0$, the main motor signal sub-unit generates a main motor driving signal, to control the main motor to rotate for the set time, and meanwhile the main motor drives a photosensitive drum, a charging unit, a developing unit, a transferring unit and an image fixing device to rotate, and makes a sound. According to the sound of the rotation of the main motor, the user can determine that the image forming apparatus is in the preheating state, rather than in failure.

Or, the laser scanning device signal sub-unit in the driving module generates a laser scanning device driving signal, to control the laser scanning device to be turned on for the set time. The motor in the laser scanning device rotates, and makes a sound. According to the sound of the rotation of the motor in the laser scanning device, the user can determine that the image forming apparatus is in the preheating state, rather than in failure.

Or, the fan signal sub-unit in the driving module generates a fan driving signal, to control the fan to work for the set time. The fan rotates, and makes a sound. According to the sound of the rotation of the fan, the user can determine that the image forming apparatus is in the preheating state, rather than in failure.

Or, the speaker signal sub-unit in the driving module generates a speaker driving signal, to control the speaker to work for the set time, and make a sound. According to the sound of the speaker, the user can determine that the image forming apparatus is in the preheating state, rather than in failure.

In the above working process of the preheating device of the image forming apparatus, power supply is maintained for the heating roller to be heated until the temperature reaches the preheating temperature, to complete the preheating operation. Then the image forming apparatus can print directly upon receiving a print command.

Embodiment 3

Figure 6:
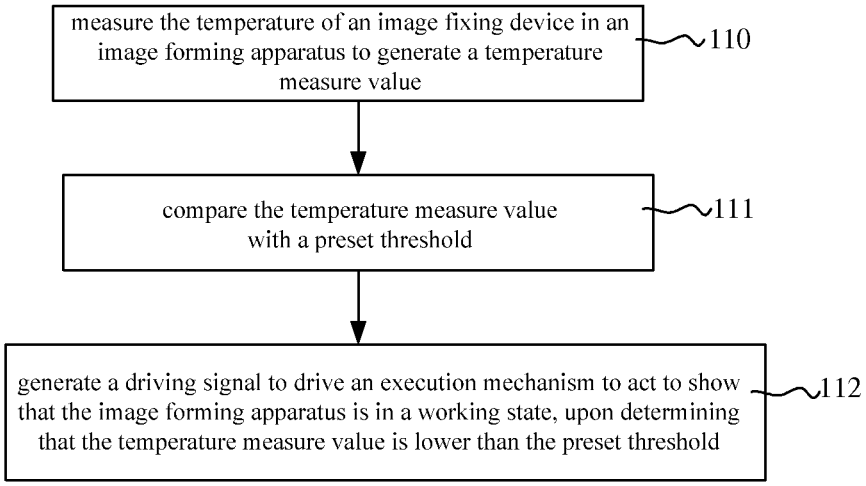
FIG. 6 is a flow chart of an image forming method according to embodiment 3 of the present invention.

FIG. 6 is a flow chart of an image forming method according to embodiment 3 of the present invention. As shown in FIG. 6, the image forming method specifically includes:

Step 110, measuring the temperature of an image fixing device in an image forming apparatus to generate a temperature measure value;

Step 111, comparing the temperature measure value with a preset threshold;

Step 112, generating a driving signal to drive an execution mechanism to act to show that the image forming apparatus is in the working state, upon determining that the temperature measure value is lower than the preset threshold.

Embodiment 4

Figure 7:
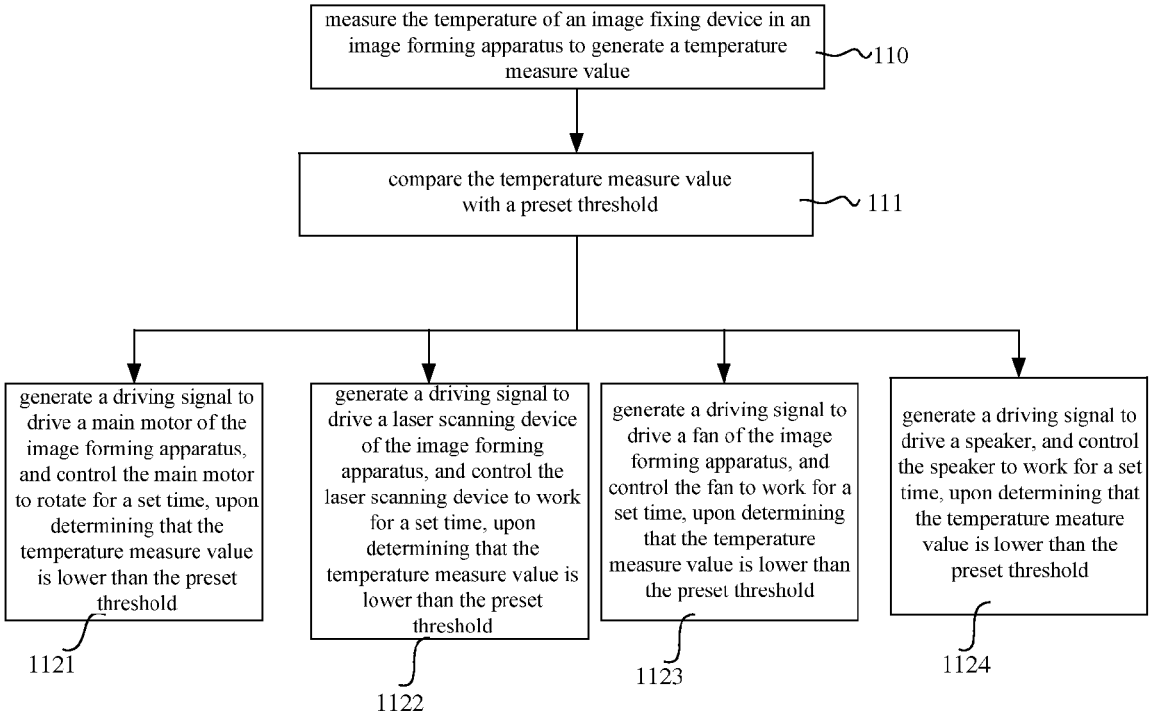
FIG. 7 is a flow chart of an image forming method according to embodiment 4 of the present invention.

FIG. 7 is a flow chart of an image forming method according to embodiment 4 of the present invention. As shown in FIG. 7, the image forming method specifically includes:

Step 110, measuring the temperature of an image fixing device in the image forming apparatus to generate a temperature measure value;

Step 111, comparing the temperature measure value with a preset threshold;

Further, driving an execution mechanism to act to show that the image forming apparatus is in the working state, specifically includes following steps:

Step 1121, generating a driving signal to drive a main motor of the image forming apparatus, and control the main motor to rotate for a set time, upon determining that the temperature measure value is lower than the preset threshold;

Step 1122, generating a driving signal to drive a laser scanning device of the image forming apparatus, and control the laser scanning device to work for a set time, upon determining that the temperature measure value is lower than the preset threshold;

Step 1123, generating a driving signal to drive a fan of the image forming apparatus, and control the fan to work for a set time, upon determining that the temperature measure value is lower than the preset threshold;

Step 1124, generating a driving signal to drive a speaker, and control the speaker to work for a set time, upon determining that the temperature measure value is lower than the preset threshold.

The above-mentioned operations of step 1121, step 1122, step 1123 and step 1124 can be performed independently, or one or more of them may be performed. No necessary timing relation exists between each step.

Further, in the above-mentioned embodiment, the preset threshold is in the range of 60° C.~100° C. Preferably, the preset threshold is 80° C.

The image forming method according to this embodiment is a manner of execution of the image forming apparatus according to the embodiments of the present invention. Cooperating with the preheating process of the image forming apparatus, the surface temperature of the heating roller in the image fixing device is measured during the preheating period, the measured temperature is compared with the preset threshold, and the execution mechanism is driven to act when the temperature is lower than the preset threshold, and then the user is prompted by the sound of the execution mechanism that the image forming apparatus is in the preheating state, rather than in failure, thus bringing convenience to the use of the apparatus.

Finally, it should be noted that the above embodiments are merely provided for describing the technical solutions of the present invention, but not intended to limit the present invention. It should be understood by persons skilled in the art that although the present invention has been described in detail with reference to the foregoing embodiments, modifications can be made to the technical solutions described in the foregoing embodiments, or equivalent replacements can be made to some technical features in the technical solutions; however, such modifications or replacements do not cause the essence of corresponding technical solutions to depart from the spirit and scope of the embodiments of the present invention.

What is claimed is:

1. An image forming apparatus, comprising an image fixing device, wherein the image forming apparatus further comprises:

a measuring module, configured to measure a temperature of the image fixing device to generate a temperature measure value; and a control module, configured to control an execution mechanism to act for a set time to show that the image forming apparatus is in a working state, upon determining that the temperature measure value is lower than a preset threshold, wherein the preset threshold is smaller than a working temperature value of the image fixing device.

2. The image forming apparatus according to claim 1, wherein the control module comprises:

a comparison module, configured to compare the temperature measure value with the preset threshold; and a driving module, configured to generate a driving signal to drive the execution mechanism to act for the set time to show that the image forming apparatus is in the working state, upon determining that the temperature measure value is lower than the preset threshold.

3. The image forming apparatus according to claim 2, wherein the driving module comprises:

a main motor signal sub-unit, connected to a main motor of the image forming apparatus, and configured to generate a main motor driving signal to control the main motor to rotate for the set time, upon determining that the temperature measure value is lower than the preset threshold; and/or a laser scanning device signal sub-unit, connected to a laser scanning device of the image forming apparatus, and configured to generate a laser scanning device driving signal to control the laser scanning device to be turned on for the set time, upon determining that the temperature measure value is lower than the preset threshold; and/or a fan signal sub-unit, connected to a fan of the image forming apparatus, and configured to generate a fan driving signal to control the fan to work for the set time, upon determining that the temperature measure value is lower than the preset threshold; and/or a speaker signal sub-unit, connected to a speaker of the image forming apparatus, and configured to generate a speaker driving signal to control the speaker to be turned on for the set time, upon determining that the temperature measure value is lower than the preset threshold.

4. The image forming apparatus according to claim 1, wherein:

the preset threshold is in the range of 60° C.~100° C.

5. The image forming apparatus according to claim 2, wherein:

the preset threshold is in the range of 60° C.~100° C.

6. The image forming apparatus according to claim 2, wherein the driving module comprises: a timer, configured to start at the same time when the driving signal is generated, and the driving signal is cancelled when the timer reaches the value of the set time.

7. The image forming apparatus according to claim 3, wherein the driving module comprises: a timer, configured to start at the same time when the driving signal is generated, and the driving signal is cancelled when the timer reaches the value of the set time.

8. The image forming apparatus according to claim 1, wherein the set time is set to be 3-5 seconds.

9. The image forming apparatus according to claim 3, wherein the set time of the main motor, the set time of the laser scanning device, the set time of the fan and the set time of the speaker are the same.

10. The image forming apparatus according to claim 3, wherein the set time of the main motor, the set time of the laser scanning device, the set time of the fan and the set time of the speaker are different.

11. An image forming method, comprising:

measuring a temperature of an image fixing device of an image forming apparatus to generate a temperature measure value;

comparing the temperature measure value with a preset threshold, wherein the preset threshold is smaller than a working temperature value of the image fixing device; and generating a driving signal to drive an execution mechanism to act for a set time to show that the image forming apparatus is in a working state, upon determining that the temperature measure value is lower than the preset threshold.

12. The image forming method according to claim 11, wherein the generating the driving signal to drive the execution mechanism to act for the set time to show that the image forming apparatus is in the working state, comprises:

generating a driving signal to drive a main motor of the image forming apparatus, and control the main motor to rotate for the set time; and/or generating a driving signal to drive a laser scanning device of the image forming apparatus, and control the laser scanning device to work for the set time; and/or generating a driving signal to drive a fan of the image forming apparatus, and control the fan to work for the set time; and/or generating a driving signal and sending the driving signal to a speaker, to control the speaker to work for the set time.

13. The image forming method according to claim 11, wherein the preset threshold is in the range of 60° C.~100° C.

14. The image forming method according to claim 11, wherein the method further comprises:

starting a timer at the same time when a driving signal is generated, and canceling the driving signal when the timer reaches the value of the set time.

15. The image forming method according to claim 12, wherein the preset threshold is in the range of 60° C.~100° C.

16. The image forming method according to claim 12, wherein the method further comprises:

starting a timer at the same time when a driving signal is generated, and canceling the driving signal when the timer reaches the value of the set time.

17. The image forming method according to claim 11, wherein the set time is set to be 3-5 seconds.

18. The image forming method according to claim 12, wherein the set time of the main motor, the set time of the laser scanning device, the set time of the fan and the set time of the speaker are the same.

19. The image forming method according to claim 12, wherein the set time of the main motor, the set time of the laser scanning device, the set time of the fan and the set time of the speaker are different.

* * * * *